United States Patent [19]

Webb et al.

[11] B 3,992,904

[45] Nov. 23, 1976

[54] NON-WOVEN FABRICS

[75] Inventors: Norman Stanley Webb, Oldham; Gordon Dunbar, Rochdale, both of England

[73] Assignee: Courtaulds Limited, London, England

[22] Filed: Nov. 8, 1974

[21] Appl. No.: 522,227

[44] Published under the second Trial Voluntary Protest Program on March 30, 1976 as document No. B 522,227.

[30] Foreign Application Priority Data

Nov. 15, 1973 United Kingdom ..... 52978/73

[52] U.S. Cl. ..... 66/190; 66/192

[51] Int. Cl.[2] ..... D04B 7/12; D04B 7/14; D04B 9/14; D04B 13/00

[58] Field of Search ..... 66/190–195, 66/84 A, 85, 85 A, 84

[56] References Cited

UNITED STATES PATENTS

| | | | |
|---|---|---|---|
| 2,890,579 | 6/1959 | Mauersberger | 66/84 UX |
| 3,597,941 | 8/1971 | Jindra | 66/194 |
| 3,664,157 | 5/1972 | Kochta et al. | 66/192 |
| 3,782,137 | 1/1974 | Hughes | 66/192 |

*Primary Examiner*—Ronald Feldbaum

*Attorney, Agent, or Firm*—Davis, Hoxie, Faithfull & Hapgood

[57] ABSTRACT

A stitch-bonded non-woven fabric of the kind comprising a web of fibers stitch-bonded by wales of chain stitch loops on one side of the fabric which are interconnected on the other side of the fabric by stitch laps is described. In a first group of succeeding courses the wales are connected by stitch laps in sets which are not connected by stitch laps to wales in adjacent sets, so that the web stands out between adjacent sets in longitudinal stripes. In a second group of succeeding courses at least one of the wales in a set in the first group of courses is connected by stitch laps to a wale outside the said set so that in the second group of courses the said longitudinal stripes are broken and the second group of courses appear as a transverse bar in which there are no longitudinal stripes in which the web stands out.

6 Claims, 8 Drawing Figures

Figure 1:
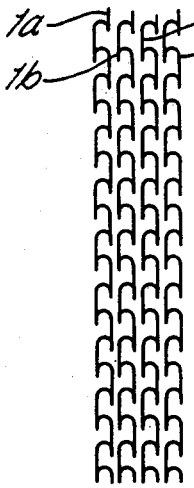

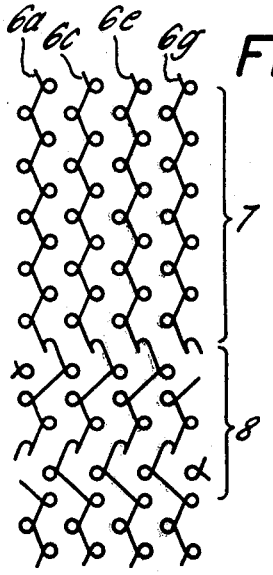
FIG. 4.
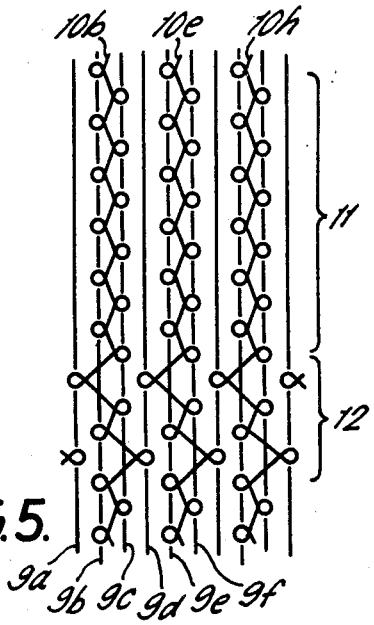
FIG. 5.
FIG. 7.
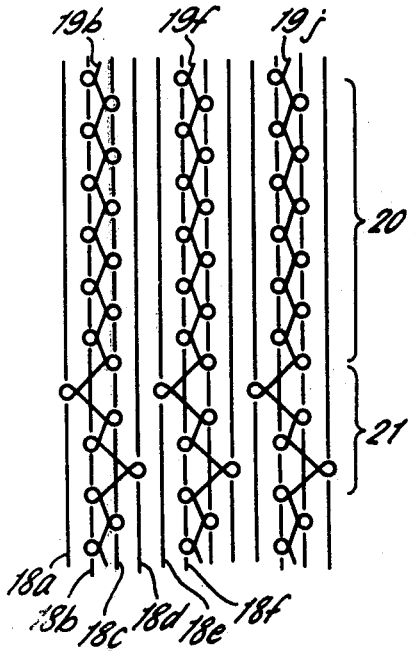
FIG. 8.
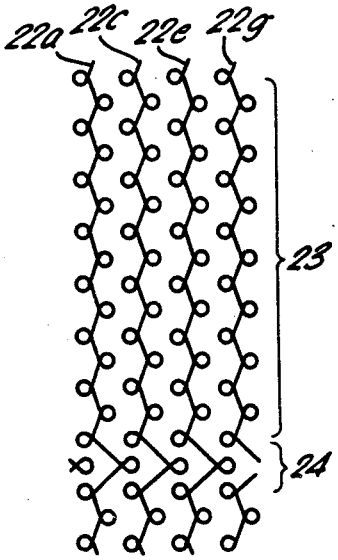

NON-WOVEN FABRICS

This invention relates to a stitch-bonded non-woven fabric, that is a fabric which consists of a non-woven web of fibers bonded by stitching threads.

In conventional stitch-bonded fabrics the bonding is in the form of longitudinally extending wales of stitches such as chain stitch formed by one guide bar and needlebed of the stitching machine. Optionally, the rows of stitches are combined with lapping stitches which connect the said wales, such as tricot stitch (defined as 1 × 1 closed lap stitch). The stitch movements of all the threads forming the lapping stitches are controlled by a second guide bar. The fibrous web stands out between the rows of stitches giving the fabric a corduroy appearance on at least one face, while the tricot stitch, if used, generally provides a inconspicuous pattern on the other face.

It is also known to produce patterned stitch-bonded fabrics by arranging that both bars of the stitching machine should form different lapping stitches. Such fabrics have the disadvantage that the matrix of interconnected stitching threads is very elastic, so that the fabric as a whole is dimensionally unstable and is difficult to finish to the desired width.

The present invention seeks to provide a stitch-bond fabric having a patterned appearance, other than the corduroy appearance given by the chain stitch, while retaining the dimensional stability given by the combination of chain stitch with a lapping stitch, and in particular to give the appearance of transverse stripes so that check effects can be achieved.

According to the invention a stitch-bonded non-woven fabric comprises a web of fibres stitch-bonded by wales of chain stitch loops on one side of the fabric which are interconnected on the other side of the fabric by stitch laps, wherein in a first group of succeeding courses the wales are connected by stitch laps in sets which are not connected by stitch laps to wales in adjacent sets so that the web stands out between adjacent sets in longitudinal stripes and in a second group of succeeding courses at least one of the wales in a set in the first group of courses is connected by stitch laps to a wale outside the said set so that in the second group of courses the said longitudinal stripes are broken and the second group of courses appear as a transverse bar in which there are no longitudinal stripes in which the web stands out. The wale or wales in a set in the first group of courses which, in the second group of courses, is or are connected to a wale or wales outside the said set may be connected to a wale or wales in a different set in the first group of courses or to a wale or wales lying between sets in the group of courses. Preferably all the wales are connected over the second group of courses.

An example of a suitable machine for producing the fabrics of the invention is an "Arachne" two-bar stitch-bonding machine. In this machine one guide bar (the top bar) is preferably used to form a chain stitch, while another guide bar (the bottom bar) forms a lapping stitch such as tricot stitch.

The preferred method of forming sets of connected wales which are not connected to adjacent sets in the first group of courses comprises a threading arrangement of the bottom bar in which some guide eyes are not threaded. For example, the guide eyes may be threaded one in, one out (i.e. alternate guide eyes threaded) in which case tricot stitch over a number of courses will produce pairs of connected wales of stitch loops formed by the top bar, which pairs are not connected to adjacent pairs so that the web stands out in the spaces between adjacent pairs.

After the first group of courses has been formed in this manner, the bottom bar shogs so that one wale of each pair formed in the first group of courses is connected to a wale outside the pair, for example by shogging across two or more needles. The longitudinal stripe formed by the spaces between pairs of wales is thus broken. Lapping stitches linking a wale in a pair with a wale outside the pair can be continued over a number of courses to form the second group. The number of courses in the second group is preferably small compared with the number of courses in the first group, so that the second group of courses appears as a widthways bar across the lengthways stripes formed in the first group of courses, giving a check effect to the fabric. The fabric pattern repeats after completion of the first and second groups of courses. The bottom bar can conveniently be controlled by a cam or a chain link system.

In the above arrangement of one in, one out threading producing pairs of connected wales over the first group of courses, both wales are of course end wales of the pair. Wales connected in sets of more than two can be produced by two in, one out or similar threading.

The stitch-bonded fabric need not have the pattern defined above across its full width. The pattern can be interspersed with bands in which the second guide bar is not threaded at all, so that these bands merely have the corduroy appearance given by the chain stitch, or bands in which the second guide bar is fully threaded, so that these bands have an inconspicuous pattern with no longitudinal stripes and only a faint hint of the transverse bar in the second group of courses. Alternatively the threading of the second bar can be varied between one in, one out and one in, two or more out, giving longitudinal stripes of different width in different parts of the fabric. In some cases (see Example 4 below) the guide bar producing chain stitch may not be fully threaded.

The type of fibres used and the density of stitches are generally as conventionally used in stitch-bonded fabrics. For example, the web of fibres can be cotton, wool, regenerated cellulose, cellulose di- or tri-acetate, acrylic or other synthetic fibres, or blends of two or more of these. The density of the web is conveniently from 100 to 700 gm/sq.m. The stitching yarn can for example be cotton, viscose filament, nylon or polyester. The number of courses is conveniently from 1.7 to 10 per cm. Good results have been obtained using standard Arachne machines having 4 needles per cm.; other needle spacings of from 2 to 10 per cm. can be used if desired.

Figure 2:
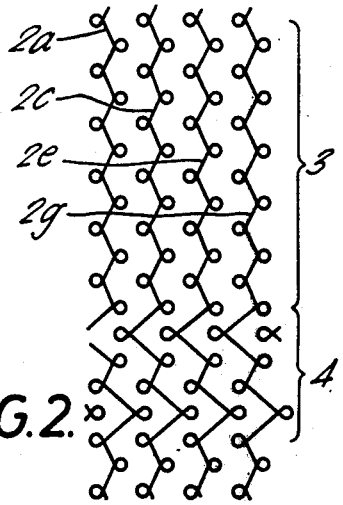
Figure 3:
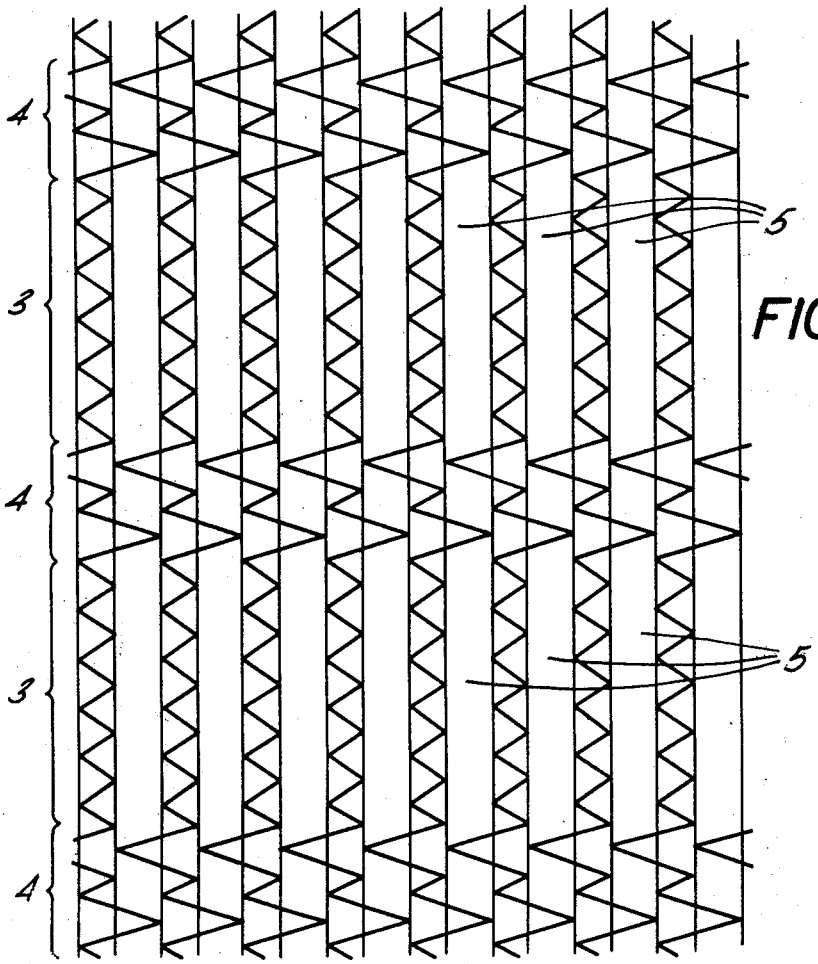
Figure 6:
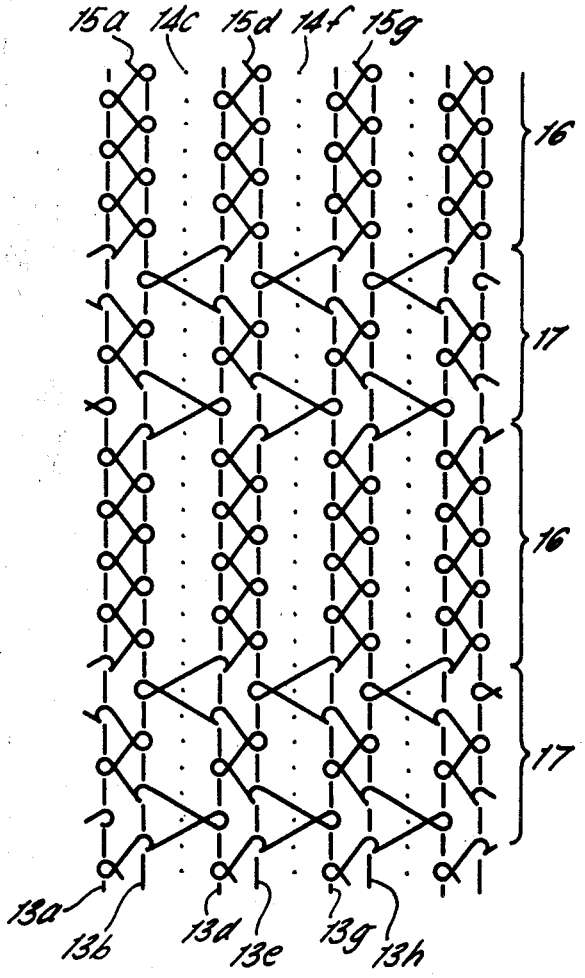

The patterned fabrics of the invention can be used for all those purposes for which stitch-bonded fabrics are conventionally used, and are particularly suitable for furnishing, drape and dress fabrics The invention is illustrated by the following Examples, which will now be described with reference to the accompanying drawings, in which:

FIGS. 1 and 2 illustrate the stitches formed by the two guide bars of a stitch-bonding machine in Example 1, FIG. 3 is a diagrammatic representation on an enlarged scale of a sample of the pattern fabric produced in Example 1, viewed from one face, FIG. 4 illustrates the stitches formed by the bottom guide bar of the stitch-bonding machine in Example 2, FIG. 5 illustrates the stitches formed by the bottom guide bar of the stitch-bonding machine in Example 3, FIG. 6 illustrates the stitches formed by the bottom guide bar of the stitch-bonding machine in Example 4, FIG. 7 illustrates the stitches formed by the bottom guide bar of the stitch-bonding machine in Example 5, and FIG. 8 illustrates the stitches formed by the bottom guide bar of the stitch-bonding machine in Example 6.

EXAMPLE 1

A web of "Sarille" (Trade Mark) regenerated cellulose fibres, 5 Dtex, average length 63 mm. and weight 220 g/sq. meter was fed to an arachne stitch-bonding machine having 4 needles per centimeter and arranged to form 7 stitch courses per centimeter. The binding warps used were "Celon" (Trade Mark) nylon thread of total denier 78 tex and composed of 16 filaments. The top bar of the machine was cam controlled to produce chain stitch and all the guides were threaded. The conventional chain stitch formed is shown in FIG. 1, in which 1*a*, 1*b*, 1*c*, 1*d* are all wales of chain stitches. The bottom bar of the machine was cam controlled to stitch in the pattern shown in FIG. 2. 2*a*, 2*c*, 2*e*, 2*g* are all wales of stitches. From FIG. 2, it will be appreciated that the bottom bar had a threading arrangement of one in, one out. For the first group 3 of 11 courses, single needle shog was used to produce tricot stitch connecting together a pair of wales of chain stitch but none of these pairs of wales was connected to an adjacent pair of wales.

Over the second group 4 of five courses a shogging sequence in successive courses of two needle pitches to the left, two needle pitches to the right, one needle pitch to the left, two needle pitches to the right and two needle pitches to the left was used so that each wale in each pair of connected wales was connected to a wale in each of the two adjacent pairs of wales. After the 16 courses described the bottom bar movement repeated, starting again with single needle shog.

FIG. 3 represents the fabric produced viewed from the face at which the tricot laps are seen. It will be appreciated that the most noticeable features of the fabric are places where the fibres of the web stand out between stitches. Over the first group 3 of courses these are the spaces 5 between adjacent pairs of wales, which appear as stripes in the fabric. Their prominence is enhanced by being somewhat wider than the distance between wales in a connected pair; the tricot stitch tends to pull the wales of chain stitches towards one another. Over the second group 4 of courses there are no a prominent spaces and the second group appears as a widthways bar giving the fabric a check effect.

When viewed from the loop side the fabric has the ridged corduroy appearance typical of chain stitch-bonded fabrics.

EXAMPLE 2

A web of Sarille fibres as described in Example 1 was stitched-bonded on an Arachne machine using nylon binding warps as described in Example 1. The top bar of the machine, with all guides threaded, produced chain stitch as shown in FIG. 1. The bottom bar of the machine was cam controlled to stitch in pattern shown in FIG. 4. 6*a*, 6*c*, 6*e*, 6*g* are all wales of stitches formed by the bottom bar. From FIG. 4, it will be appreciated that the bottom bar had a threading arrangement of one in, one out. For the first group 7 of 10 courses tricot stitch was used to connect pairs of wales of chain stitch, but none of these pairs of wales was connected to an adjacent pair of wales. In the second group 8 of six courses each wale in each pair was connected to a wale in each adjacent pair of wales as shown. After the 16 courses described the bottom bar movement repeated.

The appearance of the fabric produced is similar to that of the fabric of Example 1. Over the first 7 of courses the web stands out between adjacent pairs of wales as stripes in the fabric pattern, and the second group 8 of courses appears as a transverse bar across the stripes.

EXAMPLE 3

A web of "Sarille" fibres was stitch-bonded as described in Example 1, using the same cam control for the bottom bar but using a threading arrangement of one in, two out. The stitching pattern is shown in FIG. 5. 9*a*, 9*b*, 9*c*, 9*e*, 9*f* all represent wales of chain stitch formed by the top bar. 10*b*, 10*e*, 10*h* are all wales of tricot stitch formed by the bottom bar. Over the first group 11 of courses each wale of tricot stitch connected together a pair of wales of chain stitch such as 9*b* and 9*c*. Between each pair of wales so connected there was a wale of chain stitch, for example 9*a* or 9*d* not connected to any other wale by under laps.

The fibres of the web stand out between the connected pairs of wales in a stripe which is split longitudinally by the single unconnected wale such as 9*d*. Over the second group 12 of courses each single unconnected wale such as 9*d* is connected by under laps to a wale in each if the pairs of wales adjacent to it, thus breaking up the longitudinal stripe and forming a transverse bar in the fabric pattern.

EXAMPLE 4

This Example used the same materials for the web of fibres and for the binding warps in Example 1, and the same density of needles and stitch courses on the Arachne machine. The top bar of the machine was controlled to produce chain stitch, each wale of stitches being as shown in FIG. 1, but the guide bar as threaded two in, one out. The bottom bar of the machine was cam controlled to stitch in the pattern shown in FIG. 6. 13*a*, 13*b*, 13*d*, 13*e*, 13*g*, 13*h* all represent wales of chain stitch formed by the top bar. The dotted lines at 14*c*, 14*f* correspond to guide bar positions on the top bar which were not threaded. 15*a*, 15*d* 15*g* are all wales formed by the bottom bar. From FIG. 6, it will be appreciated that the bottom bar had a threading arrangement of one in, two out. For the first group 16 of nine courses single needle shog was used to produce tricot stitch, and the wales of chain stitch were connected in pairs 13*a*-*b*, 13*d*-*e*, 13*g*-*h*. None of these pairs was connected to adjacent pairs. Over the second group 17 of seven courses a shogging sequence in successive courses of two needle pitches to the left, two needle pitches to the right, one needle pitch to the right, one needle pitch to the left, one needle pitch to the right, two needle pitches to the right, and two needle pitches to the left was used so that each wale of a pair of connected wales was connected to a wale in a different one of the two adjacent pairs of wales. After the 16 courses described the bottom bar movement repeated.

Over the first group 16 of courses the prominent pattern features of the fabric produced are the stripes where the fibres of the web stand out in spaces such as that between 13*b* and 13*d* and that between 13*e* and 13*g*. These stripes are twice as wide as the stripes in Example 1 and the web fibres are able to stand out more from the fabric surface. Over the second group 17 of courses there are no prominent spaces where the web fibres stand out and the second group appears as a widthways bar giving the fabric a check effect.

EXAMPLE 5

A web of Sarille fibres was stitch-bonded as described in Example 1, using the same cam control for the bottom bar but using a threading arrangement of one in, three out. The stitching pattern is shown in FIG. 7. 18*a*, 18*b*, 18*c*, 18*d*, 18*e*, 18*f*, all represent wales of chain stitch formed by the top bar. 19*b*, 19*f*, 19*j* are all wales of tricot stitch formed by the bottom bar. Over the first group 20 of courses each wale of tricot stitch connected a pair of wales of chain stitch such as 18*b* and 18*c*. Between each connected pair of wales there were two wales of chain stitch, for example 18*d* and 18*e*, neither of which was connected to any other wale. The fibres of the web stand out between the connected pairs of wales in a stripe which is longitudinally split into three. Over the second group 21 of courses as shown, each of the two wales adjacent to a connected pair of wales is connected to a different wale of that connected pair; for example the wales 18*a* and 18*d* are connected to wales 18*c* and 18*b*. The longitudinal stripe is thus interrupted and a transverse bar is formed in the fabric pattern.

EXAMPLE 6

This Example used the same materials for the web of fibres and for the binding warps as in Example 1, the same density of needles and stitch courses on the Arachne machine and the same full chain-stitching as shown in FIG. 1. The bottom bar of the machine was controlled to stitch in the pattern shown in FIG. 8. 22*a*, 22*c*, 22*e*, 22*g*, are all wales formed by the bottom bar. From FIG. 8, it will be appreciated that the bottom bar had a threading arrangement of one in, one out. For the first group 23 of 14 courses tricot stitch was used to connect pairs of wales of chain stitch, but none of these pairs of wales was connected to an adjacent pair of wales. The second group 24 of two courses used 2 × 1 closed lap stitch to connect a wale in each connected pair with a wale in an adjacent connected pair. After the 16 courses described the bottom bar movement repeated.

Over the first group 23 of courses the web stands out between adjacent pairs of wales as a longitudinal stripe in the fabric pattern. The second group 24 of courses appears as a narrow transverse bar across the stripes.

What is claimed is:

1. A stitch-bonded non-woven fabric comprising a web of fibres stitch-bonded by wales of chain stitch loops on one side of the fabric which are interconnected on the other side of the fabric by stitch laps, wherein in a first group of successive courses the wales are connected by stitch laps in sets which are not connected by stitch laps to wales in adjacent sets so that the web stands out between adjacent sets in longitudinal stripes and in a second group of successive courses, consisting of less courses than the first group of courses, all the wales are connected by stitch laps so that in the second group of courses the said longitudinal stripes are broken and the second group of courses appear as a transverse bar in which there are no longitudinal stripes in which the web stands out.

2. A fabric as claimed in claim 1 in which each wale in a set in the first group of courses which, in the second group of courses, is connected by stitch laps to a wale outside the said set is connected by stitch laps in the second group of courses to a wale which is in a different set in the first group of courses.

3. A fabric as claimed in claim 1 in which each wale in a set in the first group of courses which, in the second group of courses, is connected by stitch laps to a wale outside the said set is connected by stitch laps in the second group of courses to a wale lying between sets in the first group of courses.

4. A fabric as claimed in claim 1 in which the wales in a set are connected in the first group of courses by 1 × 1 closed lap stitch, wherein adjacent wales of the 1 × 1 closed lap stitch which connect different sets of wales of chain stitch are separated by a distance greater than the distance shogged by the lap stitch in the first group of courses so that the wales of chain stitch in each set are kept unconnected over the first group of courses to wales in adjacent sets.

5. A fabric as claimed in claim 4 in which the lapping stitch laps across two or more wales of chain stitch in at least one of the second group of courses.

6. A fabric as claimed in claim 4 in which the first group of courses is formed by wales of 1 × 1closed lap stitch separated from one another by twice the distance separating adjacent wales of chain stitch and thereby connecting the wales of chain stitch in pairs.

* * * * *

UNITED STATES PATENT AND TRADEMARK OFFICE

CERTIFICATE OF CORRECTION

PATENT NO. : 3992904

DATED : November 23, 1976

INVENTOR(S) : Norman Stanley Webb and Gordon Dunbar

It is certified that error appears in the above-identified patent and that said Letters Patent are hereby corrected as shown below:

Col. 1, line 54, after "the" insert --first--

Col. 2, line 56, "Arachne" should be in quotes --"Arachne"--

Col. 3, line 19, "Arachne" should be in quotes --"Arachne"--

Col. 3, line 57, delete "a"

Col. 3, line 64, "Sarille" should be in quotes --"Sarille"--

Col. 3, line 65, "Arachne" should be in quotes --"Arachne"--

Col. 4, line 46, "Arachne" should be in quotes --"Arachne"--

Col. 5, line 16, "Sarille" should be in quotes --"Sarille"--

Col. 5, line 42, "Arachne" should be in quotes --"Arachne"--

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*